United States Patent [19]

Berg

[11] Patent Number: 5,035,658

[45] Date of Patent: Jul. 30, 1991

[54] ELECTRICAL CONNECTOR AND TERMINAL THEREFORE

[75] Inventor: B. Alan Berg, Leedon Court, Singapore

[73] Assignee: Molex Incorporated, Lisle, Ill.

[21] Appl. No.: 483,476

[22] Filed: Feb. 21, 1990

[51] Int. Cl.[5] ..... H01R 13/432

[52] U.S. Cl. ..... 439/748; 439/852

[58] Field of Search ..... 435/744, 748, 877, 835, 435/852, 851

[56] References Cited

U.S. PATENT DOCUMENTS

| | | | |
|---|---|---|---|
| 3,796,987 | 3/1974 | Kincaid et al. | 439/748 |
| 4,580,341 | 4/1986 | Chapelot | 439/767 X |
| 4,593,963 | 6/1986 | Endo et al. | 439/852 X |
| 4,708,416 | 11/1987 | Awano | 439/851 |

OTHER PUBLICATIONS

Ritchie & Lucius, "Modular Mass Termination System", 10-1980, p. 95.

*Primary Examiner*—Eugene F. Desmond

*Attorney, Agent, or Firm*—Louis A. Hecht; Stephen Z. Weiss; Charles S. Cohen

[57] ABSTRACT

An electrical connector includes a housing and a terminal. The housing has an elongated cavity with an inner end and an outer end. The height of the inner end of the cavity is less than the height of the outer end of the cavity. The terminal has an elongated base having a contact receptacle at an inner end and a conductor terminating portion at an outer end. The terminal has a first pair of opposing support sections extending upwardly from opposite lateral sides of the inner end of the base for receiving therebetween a mating contact member. A second pair of opposing support sections extend upwardly from the terminal base at a position intermediate the ends of the base. The height of the first pair of opposing support sections is less than the height of the second pair of opposing support sections and complementary to the difference in heights between the inner and outer ends of the housing cavity.

11 Claims, 2 Drawing Sheets

ELECTRICAL CONNECTOR AND TERMINAL THEREFOR

FIELD OF THE INVENTION

This invention generally relates to electrical connectors and, more particularly, to an electrical connector including a solderless terminal.

BACKGROUND OF THE INVENTION

In communications, data processing and like applications, electrical connectors are provided with reliable solderless interconnections with electrical conductors, particularly using miniaturized, high contact density connectors. Such a connector includes a housing having cavities for receiving terminals terminated to insulated conductors. In one mating connector, the terminal has a female contact portion at one end which is inserted into a respective cavity, with a trailing or opposite end terminated to the conductor. When a male pin is inserted into the female contact portion, an electrical connection is made with the pin.

One of the problems with electrical connectors of the character described is in providing a secure fit between the terminal and the housing cavity. The housing usually is molded of plastic material and the terminal cavities in the housing are formed by die core inserts which are retracted after the molding operation. In order to afford retraction of the core inserts, interior areas of the cavities are of lesser dimensions than outer areas of the cavities. The terminals often are fabricated from sheet metal material which is stamped and formed to the shape of the desired terminal. The terminal must have female receptacle means at one end and conductor terminal means at the other end. Support sections usually are provided to support the terminal in its respective cavity against twisting or other undesirable movement relative to the housing. Often, the terminal has longitudinal rigidifying means and latch means in addition to the other stated portions or sections. Keeping in mind that all of these functional portions of the terminal are provided within an extremely small stamped and formed metal member, it can be understood why it most often is difficult to insert and remove the terminal from its respective molded cavity.

This invention is directed to providing a new and improved electrical connector of the character described including an improved terminal construction providing self-contained rigidity as well as improved support within a connector housing cavity.

SUMMARY OF THE INVENTION

An object, therefore, of the invention is to provide a new and improved electrical connector and terminal construction.

In the exemplary embodiment of the invention, an electrical connector is disclosed wherein a housing has an elongated cavity with an inner end and an outer end. The height of the inner end of the cavity is less than an area of the cavity spaced from the inner end in a direction toward the outer end. A complementary terminal includes an elongated base having contact receptacle means at one end and conductor terminal means at the other end. The terminal is inserted into the housing cavity with the contact receptacle means leading and the conductor terminal means trailing.

Specifically, the terminal has a first pair of opposing support sections extending upwardly from opposite lateral sides at the one end of the elongated base for receiving a mating contact member, such as a pin, inserted into the receptacle means of the terminal. A second pair of opposing support sections extend upwardly from the base at a position intermediate the ends of the base. The opposing support sections laterally support the terminal within the housing cavity. The height of the first pair of opposing support sections is less than the height of the second pair of opposing support sections to facilitate insertion and removal of the terminal in a respective cavity in the housing.

The receptacle means of the terminal are defined by a pair of resilient contact beams having distal ends pointing in a direction toward the conductor terminal means at the other end of the base. The beams are formed integral with the first pair of opposing support sections. In addition, the base of the terminal is generally flat and includes a reinforcing rib formed integrally with the base and extending lengthwise thereof in the area of the second pair of opposing support sections. The reinforcing rib projects upwardly from the flat base. A latch tab is formed out of the base and projects from the underside thereof for latching into a complementary recess in an appropriate connector housing.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
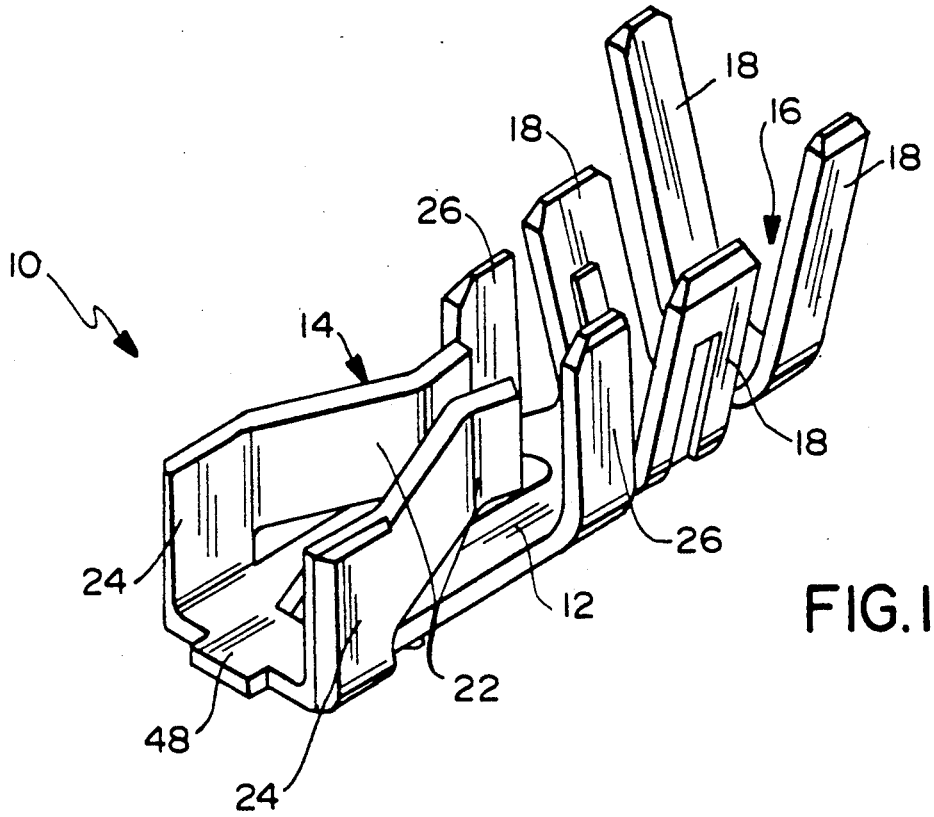
FIG. 1 is a perspective view of an electrical connecting terminal for a connector, according to the concepts of the invention.

Referring to the drawings in greater detail, and first to FIG. 1, the invention is directed to an electrical connector which includes one or more terminals, generally designated 10, which are inserted into appropriate cavities in a connector housing which will be described in greater detail in relation to FIG. 4.

More particularly, terminal 10 is fabricated from sheet metal material by an appropriate stamping and forming process. The terminal includes an elongated, generally flat base 12 having contact receptacle means, generally designated 14, at one end, and conductor terminal means, generally designated 16, at the other end.

Conductor terminal means 16 is in the form of two opposing pairs of tabs 18 which are provided for crimping over an electrical cable to establish an electrical connection therewith. It can be seen that the slots which separate the two opposing pairs of tabs 18 end at points 20 above flat base 12 to provide rigidity in a vertical direction or in planes generally transverse to the flat base. At this point, it should be understood that notwithstanding the fact that the electrical connector may be used in omnidirectional applications, the use of such terms as "upwardly", "above", "below" and the like in this specification and the claims hereof are in reference to the orientation of terminal 10 in the drawings, particularly, FIGS. 1-3.

Contact receptacle means 14 is formed by a pair of resilient contact beams 22 which form a female receptacle of terminal 10 to receive a male contact, such as a male pin, inserted between beams 22 to establish an electrical connection with the pin. It can be seen that the pair of beams are bent toward each other to provide an inwardly tapering female receptacle.

A first pair of opposing support sections 24 extend upwardly from opposite lateral sides of base 12 at the receptacle means end thereof for receiving the mating male contact or pin therebetween.

A second pair of opposing support sections 26 extend upwardly from base 12 at a position intermediate the ends of the base and, more particularly, intermediate receptacle means 14 and conductor terminal means 16.

Figure 2:
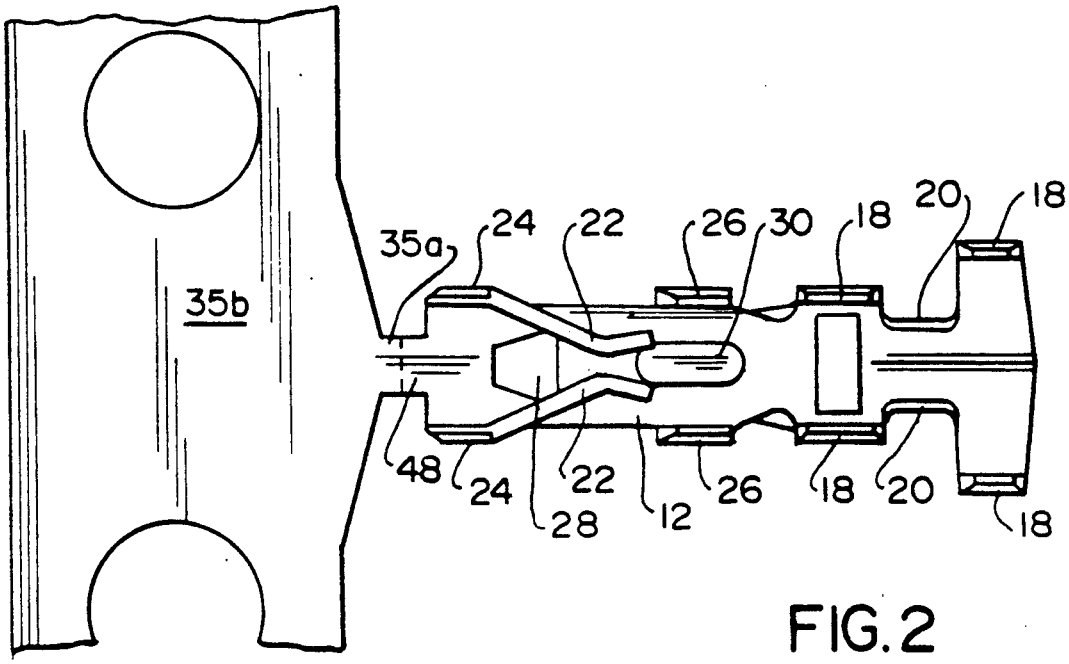
FIG. 2 is a top plan view of the terminal of FIG. 1.

FIG. 2 shows more definitively the tapering nature of resilient beams 22 and, in conjunction with FIG. 1, it can be seen that the beams are formed integral with the first pair of opposing support sections 24. In addition, it can be seen that the rear pair of crimping tabs 18 are spread wider apart than the forward pair of tabs 18 so that the rear pair of tabs can be crimped over an insulated portion of the electrical cable, and the forward pair of tabs can be crimped over the exposed conductor of the cable.

Figure 3:
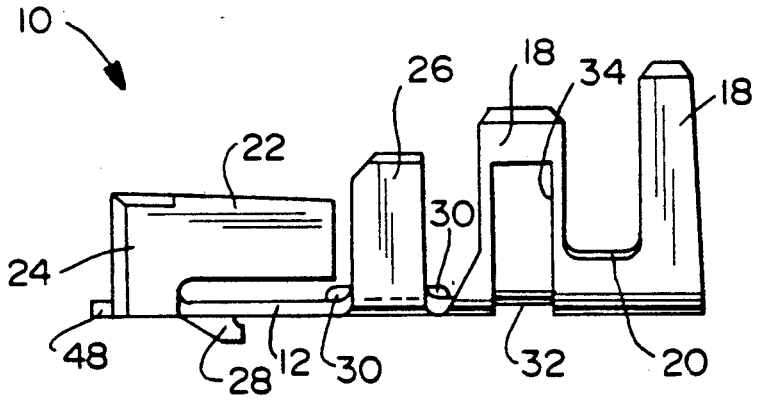
FIG. 3 is a side elevational view of the terminal of FIG. 1.

Referring to FIG. 3, the invention contemplates that the height of the first pair of opposing support sections 24 be less than the height of the second pair of opposing support sections 26. This can be seen clearly in FIG. 3. This differential in height between the two pairs of opposing support sections facilitate insertion and removal of the terminal in a complementary cavity of an appropriate connector housing because such cavities preferably are molded in one configuration or another to enable removal of the molding core inserts, as described above.

FIGS. 2 and 3 also show a latch tab 28 which is stamped out of the terminal sheet metal blank to project below base 12 for latching into a complementary recess in the connector housing, as described hereinafter.

FIGS. 2 and 3 further show a reinforcing rib 30 formed out of and integral with base 12 and extending lengthwise thereof to at least span the lengthwise area of the second pair of opposing support sections 26. Reinforcing rib 30 projects upwardly from base 12 between the second pair of opposing support sections 26 so as not to have any projections below base 12, as seen in FIG. 3, which might interfere with smooth insertion of the terminal into a respective housing cavity.

Still further, FIG. 3 shows that the underside of base 12, as at 32, and the outsides of inner crimping tabs 18, as at 34, are stamped/embossed to form recessed areas which reinforce the tabs for crimping over the conductor portion of the electrical cable.

Lastly, FIG. 2 shows one terminal 10 still connected by a web 35*a* to a strip 35*b* of the blank form which a plurality of terminals are formed. The web is cut at a point intermediate its ends to release the terminal, as shown in FIG. 3.

Figure 4:
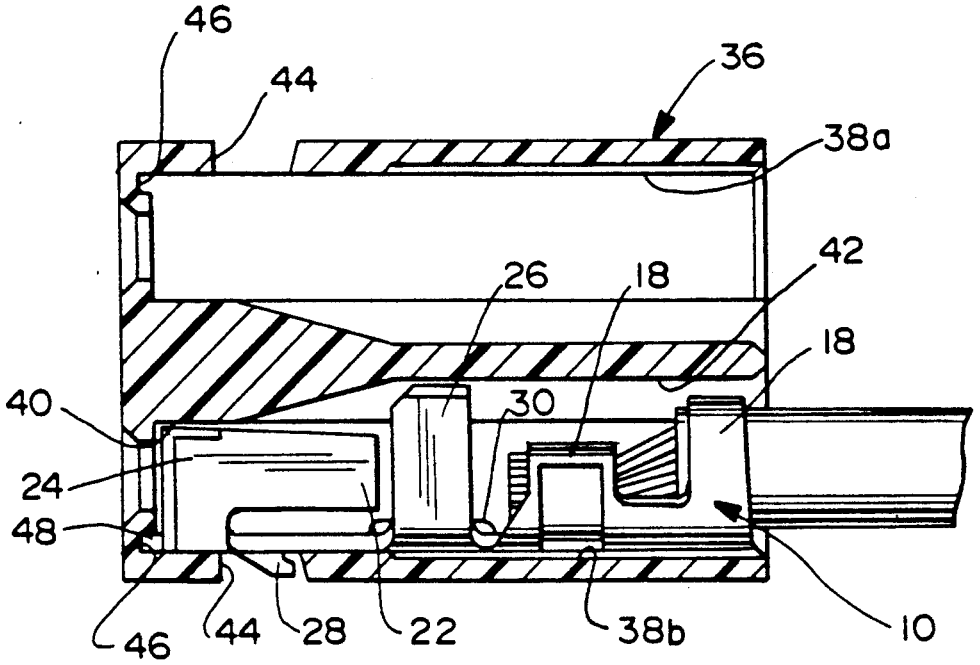
FIG. 4 is a vertical section through a housing having two cavities for receiving two terminals as shown in FIG. 1.

FIG. 4 shows a vertical section through a housing, generally designated 36, which has upper and lower cavities 38*a* and 38*b*, respectively, for receiving a pair of the terminals 10. Of course, it should be understood that many more cavities could be provided, including rows of cavities in a direction perpendicular to the plane of the drawing. Each cavity 38*a*, 38*b* is identical except for the fact that it can be seen that upper cavity 38*a* simply is inverted in relation to lower cavity 38*b*. To that end, a terminal 10 is shown only in lower cavity 38*b* in order to b consistent in using the terms "upwardly", etc. as discussed above. Upper cavity 38*a* simply is a mirror image of lower cavity 38*b* which now will be described in relation to terminal 10 illustrated as inserted into cavity 38*b*.

More particularly, each cavity 38*a* (38*b*) has an inner end 40 and an outer end 42. It can be seen that the height of inner end 40 is less than the height of outer end 42. Therefore, during a molding process, the mold core inserts which form the cavities can be readily withdrawn without the extreme inner ends of the inserts hanging-up as the inserts are pulled out of the cavities when a molding process is completed.

Therefore, it can be seen that the lesser height of the first pair of opposing support sections 24 of terminal 10 is complementary to the lesser height of inner end 40 of a respective cavity and, likewise, the height of the second pair of opposing support sections 24 is complementary to the height of outer end 42 of the respective cavity.

FIG. 4 also shows that housing 36 has apertures or recesses 44 into which latch tabs 28 of the terminals snap to lock the terminals in their respective cavities.

Lastly, FIG. 4 shows that the inner ends of cavities 38*a*, 38*b* have recessed areas 46 for receiving tab-like extensions 48 (seen best in FIG. 3) of terminals 10 to facilitate positioning the terminals in respective cavities and further support the terminals against movement, particularly in a vertical direction. Support sections 24, 26 support the terminals in a lateral direction, the cavities having lateral configurations and dimensions for mating with the lateral profile of the terminals.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

I claim:

1. A terminal for an electrical connector, comprising:

elongated base having contact receptacle means at one end and conductor terminal means at the other end;

a first pair of opposing support sections extending upwardly from opposite lateral sides at said one end of the base for receiving therebetween a mating contact member into said receptacle means;

a second pair of opposing support sections extending upwardly from the base at a position intermediate the ends of the base; and wherein the height of the first pair of opposing support sections is less than the height of the second pair of opposing support sections to facilitate insertion and removal of the terminal in a complementary cavity of an appropriate connector housing, the terminal further including a pair of resilient contact beams defining said receptacle means, the beams having distal ends pointing in a direction toward said other end of the base and of a length such that they do not contact said second pair of opposing support sections when the mating contact member is received in said receptacle means.

2. The terminal of claim 1 wherein ends of said beams opposite said distal ends are formed integral with said first pair of opposing support sections.

3. The terminal of claim 1 wherein said base is generally flat, and including a reinforcing rib formed integrally with the base and extending lengthwise thereof.

4. The terminal of claim 3 wherein said reinforcing rib spans the lengthwise area of the second pair of opposing support sections.

5. The terminal of claim 4 wherein said reinforcing rib projects upwardly from the base between the second pair of opposing support sections.

6. An electrical connector, comprising:

a unitary molded housing having an elongated cavity with an inner end and an outer end, the height of the inner end of the cavity being less than the height of an area of the cavity spaced from the inner end in a direction toward the outer end;

a terminal for insertion into the cavity of the housing, including an elongated base having contact receptacle means at an inner end and conductor terminal means at an outer end, a first pair of opposing support sections extending upwardly from opposite lateral sides at said inner end of the base, positioned in the inner end of the housing cavity, for receiving a mating contact member into said receptacle means, a second pair of opposing support sections extending upwardly from the base at a position intermediate the ends of the base and located in the outer end of the housing cavity, and wherein the height of the first pair of opposing support sections is less than the height of the second pair of opposing support sections substantially complementary to the different heights of the respective inner and outer ends of the housing cavity.

7. The electrical connector of claim 6 including a pair of resilient contact beams defining said receptacle means, the beams having distal ends pointing in a direction toward said outer end of the base and of a length such that they do not contact said second pair of opposing support sections when the mating contact member is received in said receptacle means.

8. The electrical connector of claim 7 wherein ends of said beams opposite said distal ends are formed integral with said first pair of opposing support sections.

9. The electrical connector of claim 6 wherein said base is generally flat, and including a reinforcing rib formed integrally with the base and extending lengthwise thereof.

10. The electrical connector of claim 9 wherein said reinforcing rib spans the lengthwise area of the second pair of opposing support sections.

11. The electrical connector of claim 10 wherein said reinforcing rib projects upwardly from the base between the second pair of opposing support sections.

* * * * *